United States Patent [19]

Stanton

[11] Patent Number: 4,802,872

[45] Date of Patent: Feb. 7, 1989

[54] REGULATED AERATION OF GASES EXHAUSTING THROUGH A PROPELLER

[76] Inventor: Robert Stanton, Box 175, Road #1, Sweet Valley, Pa. 18656

[21] Appl. No.: 904,151

[22] Filed: Sep. 5, 1986

[51] Int. Cl.[4] ..... B63H 1/28

[52] U.S. Cl. ..... 440/89; 416/93 A

[58] Field of Search ..... 440/89; 416/90 A, 90 M, 416/93 A, 93 M, 92, 94, 245 A; 415/115; 137/855, 524

[56] References Cited

U.S. PATENT DOCUMENTS

| | | | |
|---|---|---|---|
| 1,166,021 | 12/1915 | Trowbridge | 137/524 |
| 1,556,791 | 10/1925 | Henderson . | |
| 3,005,523 | 10/1961 | May | 137/855 |
| 3,045,762 | 7/1962 | Gaubis et al. | 416/94 |
| 3,092,185 | 6/1963 | Alexander, Jr. . | |
| 3,279,415 | 10/1966 | Kiekhaefer . | |
| 3,371,645 | 3/1968 | Ward . | |
| 3,788,267 | 1/1974 | Strong . | |
| 3,862,747 | 1/1975 | Richter | 415/115 |
| 3,947,151 | 3/1976 | Stillerud et al. . | |
| 4,097,191 | 6/1978 | Genuardi . | |
| 4,276,036 | 6/1981 | Nishida et al. . | |
| 4,511,339 | 4/1985 | Kasschau . | |
| 4,545,771 | 10/1985 | Lio | 440/89 |
| 4,631,032 | 12/1986 | Nishida | 416/93 A |

*Primary Examiner*—Sherman D. Basinger
*Assistant Examiner*—Thomas J. Brahan
*Attorney, Agent, or Firm*—Fleit, Jacobson, Cohn & Price

[57] ABSTRACT

Aeration holes defined by an outer propeller hub include closure devices which seal the aeration holes during rotation of the propeller due to centrifugal forces in a predetermined speed of rotation range. The aeration holes provide high power at low boat speeds and are sealed at high boat speeds to avoid further aeration and loss of forward thrust. The speed of rotation at which the aeration hole are sealed is adjustable.

9 Claims, 5 Drawing Sheets

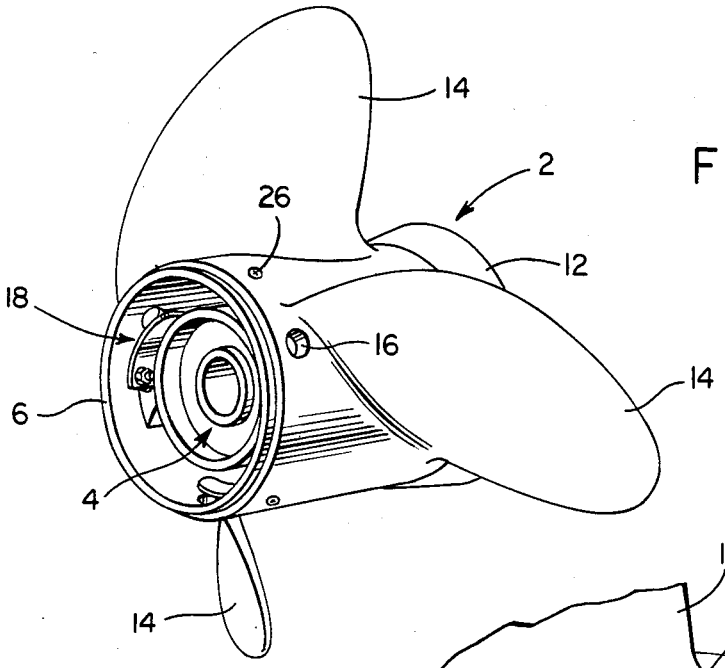
FIG. 1
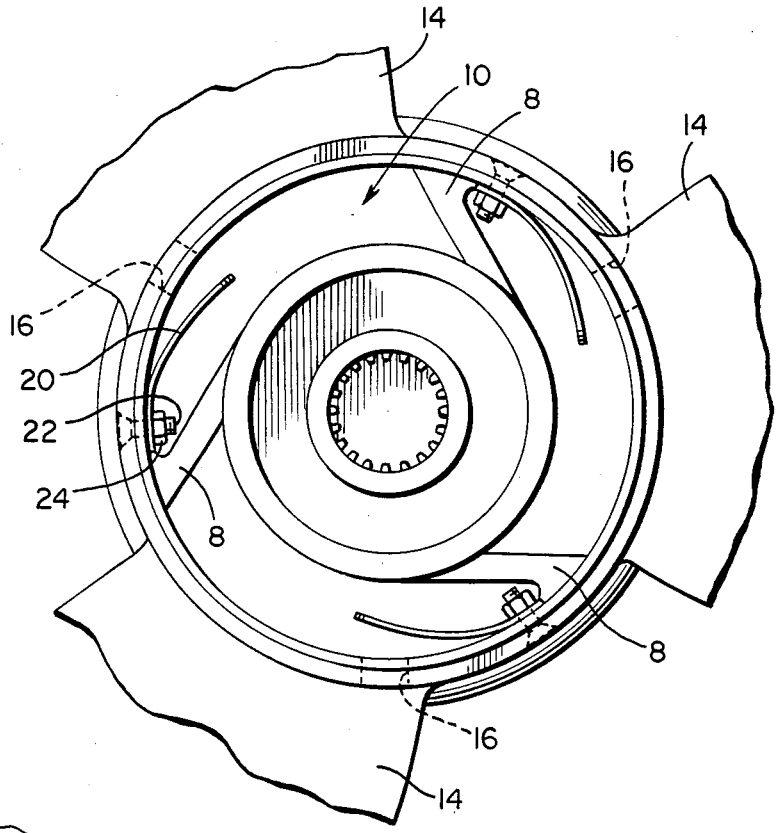
FIG. 2
FIG. 3
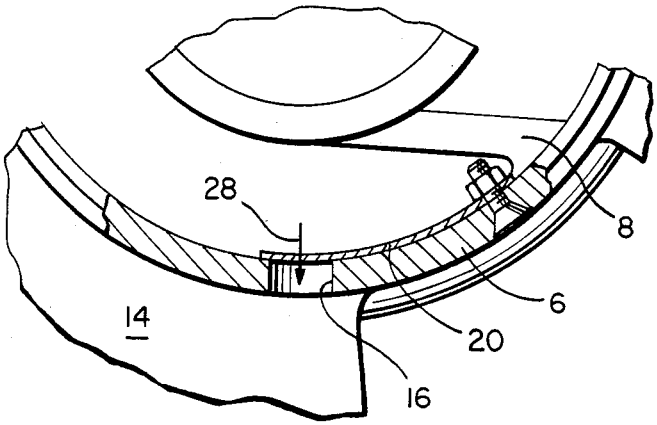
FIG. 4
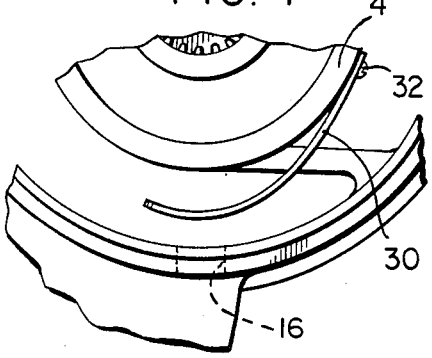

FIG. 18
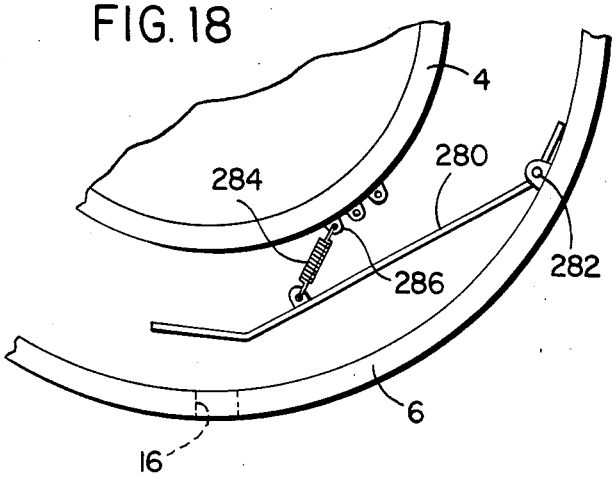
FIG. 20
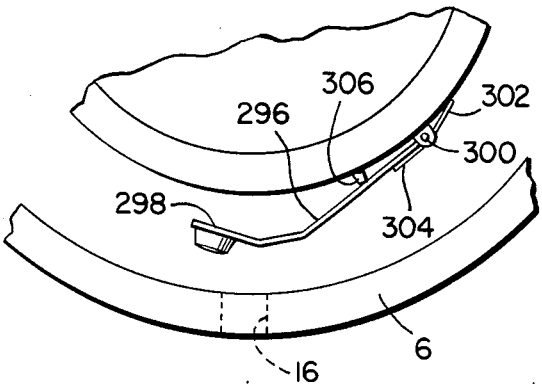
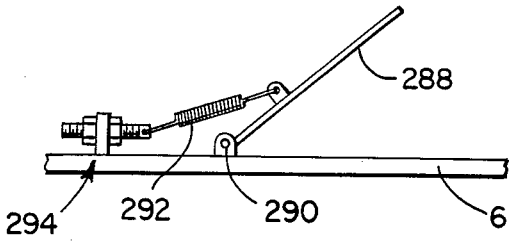
FIG. 19
FIG. 21
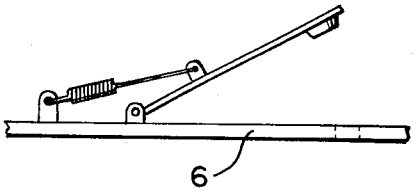
FIG. 22
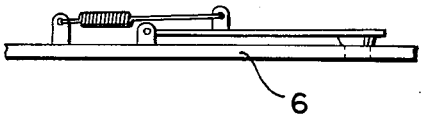
FIG. 23
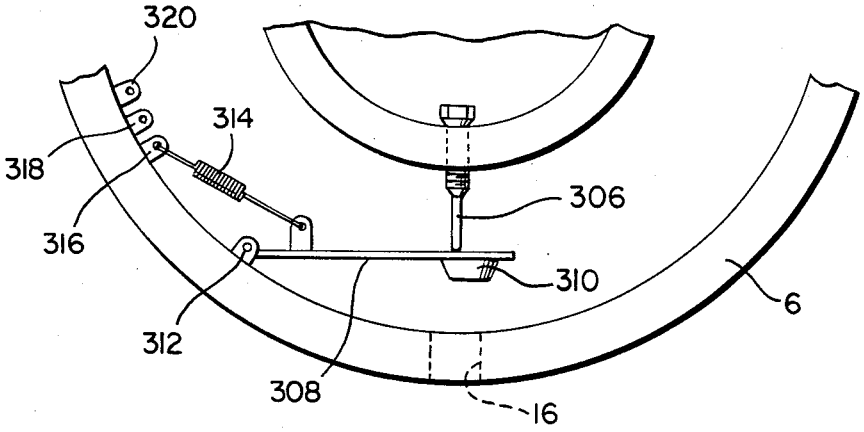

REGULATED AERATION OF GASES EXHAUSTING THROUGH A PROPELLER

BACKGROUND OF THE INVENTION

The present invention involves regulation of a gas exhausted through a propeller. The regulation is dependent on a predetermined speed or range of revolutions per minute (rpm) of the propeller.

As disclosed in U.S. Pat. No. 3,279,415 to Kiekhaefer and U.S. Pat. No. 4,511,339 to Kasschau, it is known to have a hollow hub propeller for discharging engine exhaust. This exhaust system is used for outboard motors, stern drive units and the like. Exhaust from the engine is directed rearwardly into the water through an annular casing formed between an inner and outer propeller hub.

Cavitation is the formation of gas- or vapor-filled cavities in liquids in motion which is produced when the pressure is reduced to a critical value while the ambient temperature remains constant. If the velocity of the flowing liquid exceeds a certain value, the pressure is reduced. It is at this point that cavitation occurs, causing a restriction on the speed at which hydraulic machinery can be run without noise, vibration, erosion of metal parts, or loss of efficiency.

As the speed of an object, such as the blades of a rotating propeller, moving through a liquid is increased, there will be a value at which cavitation bubbles will form. During cavitation, if a collapsing bubble is close to metal, the impact can cause mechanical destruction so that the metal becomes pitted or eaten away. Cavitation is accompanied by noise that ranges from a low rumble to loud knocks. The formation and collapse of the bubbles requires energy, so that its presence in fluid machinery produces a drop in efficiency. The possibility of cavitation is reduced as the total pressure in the fluid is increased, its temperature reduced, or its velocity decreased.

In U.S. Pat. No. 3,947,151 to Stillerud et al, a hollow hub marine propeller is disclosed having an anticavitation groove. An external groove girdles the hub between the propeller blades and a rear hub opening. The walls of the groove or annular cavity do not extend outwardly of the hub and thereby offer minimal water resistance. The groove serves to minimize forward migration of exhaust gas issuing from the rear end of the hub, thus to minimize blade cavitation.

Also disclosed in the patent to Stillerud et al are radially extending9 holes emanating from the bottom of an anticavitation groove and extending to an internal passageway of the hub. The holes are described as not usually being desired but under some conditions may serve to assist in the release of water from the groove into the volume of reduced pressure. It is stated that insofar as the holes permit escape of exhaust gas from the hub interior into the volume of reduced pressure, such holes would, however, tend to defeat the purposes of the Stillerud et al invention.

In U.S. Pat. No. 3,788,267 to Strong, anticavitation means for a marine propulsion device are disclosed. In the Strong patent, cavitation eminating from the leading edge near the hub of a propeller of a marine propulsion device is prevented by introducing exhaust gas or air adjacent the junction of the leading edge of each blade of the propeller and the propeller hub.

Strong discloses one or more holes spaced axially along the root of a blade which is radially mounted on an outer hub. The holes provide a source of gas for delivery to the area of each of the blades in which a sufficiently low pressure would exist to cause cavitation bubbles to develop. Due to relief of the vacuum by the gas flowing through the holes, no cavitation bubbles are produced so that there are no cavitation bubbles collapsing on the face of the propeller blades.

Aeration holes are not to be confused anti-cavitation holes, large aeration holes will promote ventilation at low speed and cavitation at high speed, whereas small anti-cavitation holes prevent only cavitation.

SUMMARY OF THE PRESENT INVENTION

Applicant has determined that the use of escaping gas such as exhaust gas or oxygen to aerate or soften the water around the propeller blades of a marine propulsion device enables the propeller to "slip" in the aerated water at low boat speeds. The slipping of the propeller at low speeds helps the engine to obtain higher rpms at low boat speeds. The higher engine rpms transmitted to the propeller slipping in the aerated water at low boat speeds brings the engine closer to its maximum power output and thus increases power transmitted to the propeller at low boat speeds.

The amount of aeration with exhaust gas is regulated by the size of the holes positioned in front of the propeller blades. Increasing the size of the hole would necessarily allow more gas to escape, causing more slip of the propeller blade to occur. When the holes become excessively large, acceleration from a standing start is excellent due to the power transmitted to the propeller slipping in aerated water at low boat speed, however, at approximately boat planing speed, the aeration from large holes becomes so great that the propeller will cavitate and slip so severely that a near complete loss of forward thrust will occur.

According to the invention, the aforementioned problems are overcome for large aeration holes.

By the present invention, extremely large aeration holes are used with closure devices which close the aeration holes off gradually at increasing rpm and eventually seals the holes or seals the holes at a predetermined rpm. This enables one to have maximum power acceleration without cavitation at both a low boat speed and at a high boat speed.

This is achieved by the regulation of the amount of exhaust gas escaping from an annular cavity through aeration holes to a leading edge of the root of the propeller blades. The aeration holes are present at low speeds for maximum power advantage and are sealed at high speeds when it has been determined that their presence creates a problem for performance.

It is therefore an object of the present invention to have excellent acceleration from a standing start for a marine propulsion device.

It is a further object of the present invention to maintain high speed performance with aeration holes defined adjacent the leading edge of the root of a propeller blade.

It is another object of the present invention to have closure devices located in an annular passage through which exhaust gas or air passes which gradually or suddenly closes an aeration hole extending radially through the propeller hub to produce excellent acceleration from a standing start for a marine propulsion device and maintenance of high speed performance at high planing speeds.

These and other objects of the invention, as well as many of the intended advantages thereof will become more readily apparent when reference is made to the following description taken in conjunction with the accompanying drawings.

BRIEF DESCRIPTION OF THE DRAWINGS

FIG. 1 is a perspective view of a propeller for a marine propulsion device.

FIG. 2 is a partial end view of the propeller shown in FIG. 1, showing a closure device in an open position.

FIG. 3 shows the closure device shown in FIG. 2 in a closed position.

FIG. 4 is an alternate embodiment of a closure device.

FIGS. 6 through 23 are alternate embodiments of closure devices for closing an aeration hole.

DETAILED DESCRIPTION OF THE PREFERRED EMBODIMENTS

Figure 5:
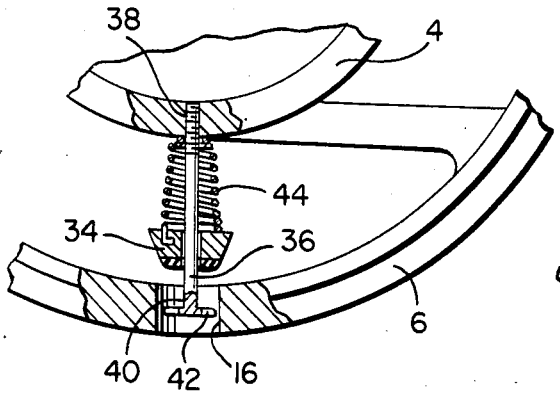
FIG. 5 illustrates a poppet valve for closing an aeration hole.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As disclosed in U.S. Pat. No. 3,788,267 to Strong, which is herein incorporated by reference, an outboard motor has a drive shaft housing, which supports a cowl at its upper end. An underwater unit is carried at the lower end of the drive shaft housing. The underwater unit includes a housing into which extends a driveshaft, which is driven by the engine of the outboard motor. The housing has a chamber formed therein between an inner wall of the housing and the outer wall of an annular member within which the driveshaft is rotatably supported. The exhaust gases from the engine in the cowl are supplied to the chamber. The driveshaft is connected by gearing to a rotatably mounted propeller shaft. The propeller shaft has a propeller 2 as shown in FIG. 1 connected to the propeller shaft for rotation therewith. The propeller 2 includes an inner hub 4 which is connected to the propeller shaft for causing rotation of the propeller 2 whenever the driveshaft is driven by the engine.

The propeller 2 includes an outer hub 6, which is spaced from the inner hub 4 by a plurality of supports 8. The supports 8 are angularly spaced from each other so as to permit an annular passage 10 to be formed between inner hub 4 and the outer hub 6. The chamber in the housing communicates with the annular passage 10 of the propeller 2 so that the exhaust gases escape from the chamber through the rear 12 of the propeller 2 and into the water through the annular passage 10.

The propeller 2 has a plurality of blades 14 formed integral therewith and extending radially outwardly from the hub 6. While the propeller 2 has been shown as having three blades 14, it should be understood that the propeller 2 may have more or less than 3 blades, if desired.

Adjacent the leading edge of each blade 14, at the root of the blade, is an opening 16 defined by the outer hub 6. Opening 6 extends through the outer hub into the annular passage 10 defined between the outer hub 6 and outermost wall of the inner hub 4. Preferably, the diameter of each opening 16 is 0.66 inches in diameter. The size of the opening is determined by the amount of power desired at low speeds for the propeller. This size opening is considered extremely large when compared against known anti-cavitation holes and produces excellent acceleration from a standing start. However, the use of such a large size hole would tend, at high speeds, to produce a near complete loss of forward thrust if left open. That is extreme cavitation occurs.

To avoid loss of forward thrust at high speeds with the large diameter hole of the present invention, a closure assembly 18 is positioned so that with increasing speed of the propeller the openings 16 are closed by centrifugal force acting on the closure assembly mounted in the rotating propller. Therefore, at high planing speeds, high speed performance is maintained by power transmitted to the propeller which was not previously possible with aeration holes found in an outer hub of a propeller.

Typically, the closure assembly initiates movement in a closing direction at a propeller speed of 1500 rpm and the aeration openings are completely closed at a propeller speed of 2,000 rpm. The speeds at which the closure assemblies initiate closing of the aeration holes and the speed at which the closing assemblies seal the aeration holes are adjustable.

The closure assembly 18 shown in FIG. 1 is shown in more detail in FIG. 2. In FIG. 2, reed 20 is made of stainless steel and is securely fastened at one end to an inner wall of the outer hub 6. A bolt 22 extends through the outer hub 6 and a nut 24 is threadingly engaged on the bolt 22 to lock one end of the reed 20 in position spaced from opening 16. Bolt head 26 is shown extending to an exterior wall of the outer hub 6.

In a preferred embodiment, the reed is approximately 0.75 inches wide and 2 inches long with a thickness of 0.012 inches thick. The reed 20 is of sufficient resiliency such that it may be forced to completely cover and seat itself against opening 16 due to the force of the exhaust gases and the centrifugal force of the propeller during rotation. The reed is located in a normally open position, as shown in FIG. 2, which is when the propeller is at rest and at very low speeds of rotation.

As the speed of rotation of the propeller increases, the reed 20 assumes a position as shown in FIG. 3 to completely cover opening 16 by movement of reed 20 in the direction of arrow 28. When the reed is seated to cover and completely seal opening 16, all the exhaust gases travel through annular passageway 10 towards rear end 12 of propeller 2 and are exhausted into the water.

In an alternate embodiment as shown in FIG. 4, a reed 30 is securely mounted at one end to a wall of inner hub 4 by a screw 32. As in FIG. 2, when the speed of the propeller increases, the reed 30 will move outwardly by centrifugal force to completely cover and seal opening 16. It is contemplated to be within the scope of the present invention to mount one end of the reed 20 in FIG. 2 or the reed 30 in FIG. 4 spaced from the opening 16 along the longitudinal axis of the propeller 2 or at any position relative to opening 16 such that upon rotation of the propeller, the reed 20 or reed 30 will move by centrifugal force acting on the free end of the reed in a direction towards the opening 16 to completely cover and seal the opening against the passage of exhaust gases.

In FIGS. 5 through 23, different sealing assemblies are disclosed for gradually sealing opening 16 in the outer hub 6 over a predetermined speed range which is adjustable over increasing speeds of rotation.

In FIG. 5, a sliding poppet valve 34 is mounted on a shaft 36 which is secured at one end 38 in inner hub 4 and the other end 40 positioned within opening 16 by a guide 42 which allows passage of a gas through the opening 16. Guide 42 is in the form of an X with its center mounted on end 40 of shaft 36 to approximately center the shaft 36 within opening 16. Spring 44 maintains poppet valve 34 spaced from opening 16 in a position of rest.

During increasing speed of rotation of the propeller poppet valve 44 is moved towards opening 16, by centrifugal force, and eventually is seated within opening 16, to completely seal opening 16 against the passage of gas from the annular passage 10 through the outer hub 6. Upon a decrease in speed of rotation, poppet valve 40 will be moved towards end 38 of shaft 36 by the force of return spring 44.

By varying the amount by which end 38 of shaft 36 is screwed into inner hub 4, the speed of rotation at which poppet valve 34 will be seated in opening 16 is adjustable.

Figure 6:
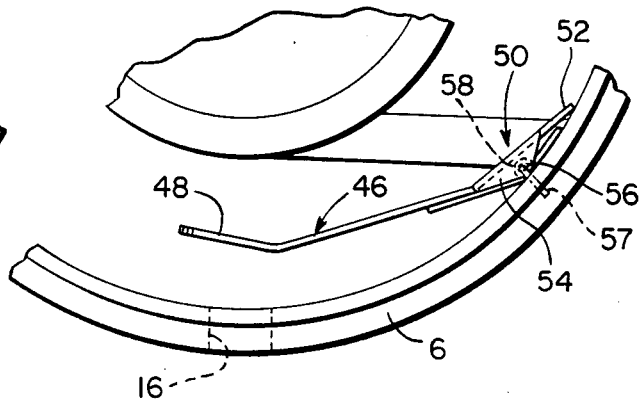

In FIG. 6, stainless steel plate 46 is shown having at one end a flat section 48 and a pivot assembly 50 at the other end 52. End 52 contacts an inner wall of the outer hub and acts as a stop for continued movement of the plate 46. The pivot assembly includes a housing 54 having a shaft 56 extending in a direction parallel to the longitudinal axis of the outer hub and extending through the housing 54. The shaft 56 has a portion 57 bent at 90° which is fixed to inner hub 6. About shaft 56 is wrapped a coil spring 58 which biases the plate 46 to the position shown. Upon application of centrifugal force by rotation of the propeller, the bias of the spring 58 is overcome and the end 48 of the reed 46 is forced down to cover and completely seal opening 16. Upon a decrease in the speed of the propeller, spring 48 biases plate 46 back to the position in which it is shown.

Figure 7:
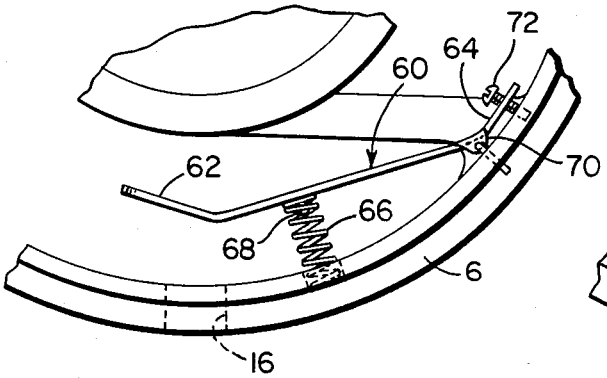

In FIG. 7, stainless steel plate 60 includes a flat end portion 62 at one end and another flat end portion 64 at its other end. Spring 66 is anchored at one end in outer hub 6 and at the other end surrounds a projection 68 extending from plate 60. The spring 66 biases the plate 60 to pivot around pivot shaft 70. Adjustable screw 72 is mounted on end 64 of plate 60 and is adjustable to set the speed of rotation of the propeller at which the plate 60 is moved to cover and seal opening 16.

Figure 8:
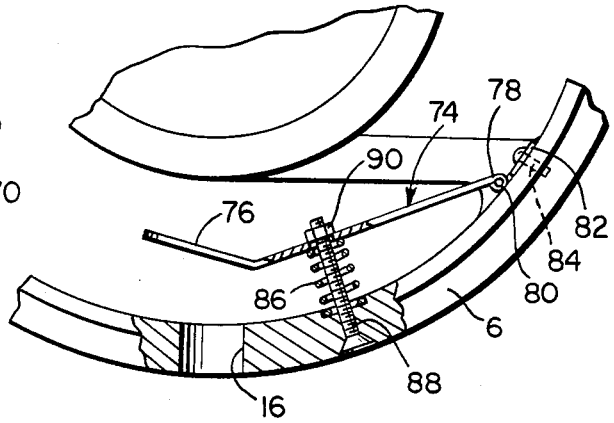

In FIG. 8, stainless steel plate 74 has flat end portion 76 and end 78 curved around pivot shaft 80 which is secured to the outer hub 6 by screw 84. Spring 86 biases the plate 74 away from the opening 16. Spring 86 surrounds shaft 88 which is anchored at one end in outer hub 6 and at its opposite end includes nut 90 which is threadably engaged on the shaft 88 to vary the position of rest of the plate 74. Upon subjecting the plate 74 to centrifugal force by rotation of the propeller, end 76 of plate 74 is forced downwardly to cover and seal opening 16.

Figure 9:
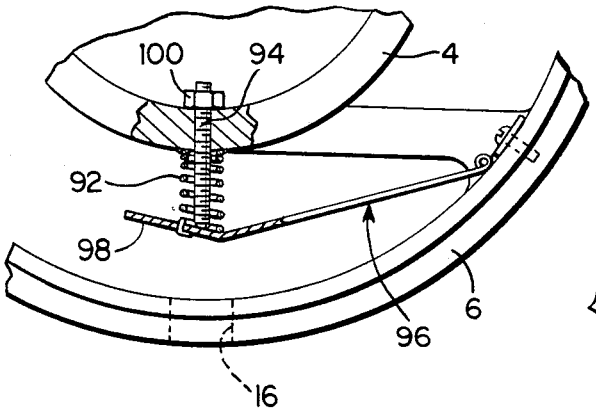

In FIG. 9, in a variation of FIG. 8, a spring 92, surrounding shaft 94, biases plate 96 away from opening 16. Shaft 94 has one end fixed to inner hub 4 as does spring 92. Upon subjecting plate 96 to centrifugal force, end 98 of the plate 96 is forced to seal and completely cover opening 16. The amount of speed necessary to move plate 96 to completely cover opening 16 is adjustable by rotation of shaft 94 which is held at a set position by nut 100.

Figure 10:
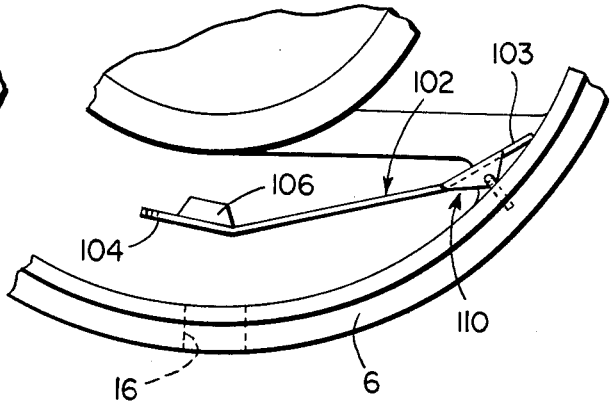

In FIG. 10, plate 102 includes flat end 104 having a weight 106 mounted thereon. Opposite end 108 forms a stop against a wall of outer hub 6. Pivot assembly 110 which is similar to pivot assembly 50 in FIG. 6 includes a spring for biasing plate 102 away from opening 16. The rpm at which the plate 102 will completely cover and seal opening 16 due to centrifugal force is adjustable by varying the amount of weight mounted on end 104 of the plate 102.

Figure 11:
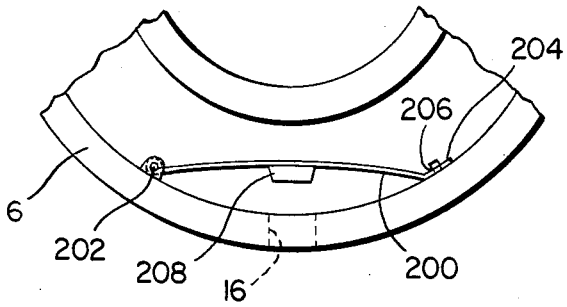

In FIG. 11, spring plate 200 is anchored at one end 202 to an inner wall of outer hub 6. The other end 204 of the plate 200 is slideably mounted in anchor 206 which is attached to an inner wall of the outer hub. A tapered closure 208 is mounted in the middle of the spring plate centered over the opening 16 so that when the propeller is rotated, the closure 208 is moved towards and seals opening 16.

Figure 12:
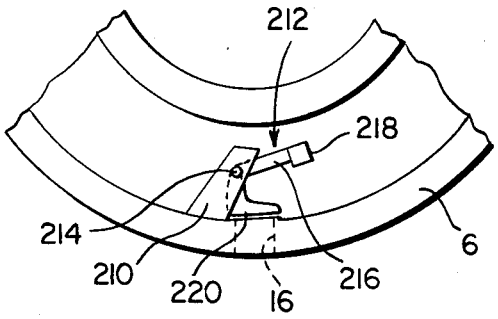

In FIG. 12, a projection 210 is mounted on an inner wall of the outer hub 6. A two-armed member 212 is pivotably mounted about pivot 214 on projection 210. One arm 216 includes a weight 218 and the arm 220 is L-shaped and shown mounted to seal opening 16. A spring (not shown) is mounted about pivot 214 to bias the member 212 away from the opening 16 and by adjustment of the size and location of the weight 218, a speed of rotation of the propeller is determined at which the arm member 220 will close opening 16 due to centrifugal force.

Figure 13:
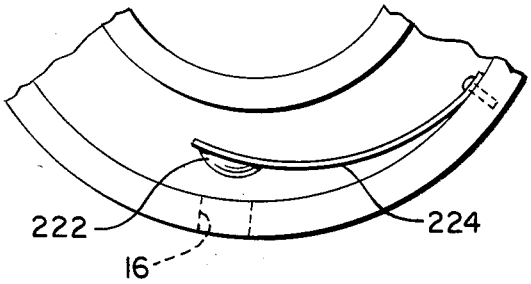

In FIG. 13, a curved closure member 222 is mounted on resilient reed valve 224, as shown in FIGS. 2 and 3, to seal opening 16 upon rotation of the propeller in a predetermined speed range.

Figure 14:
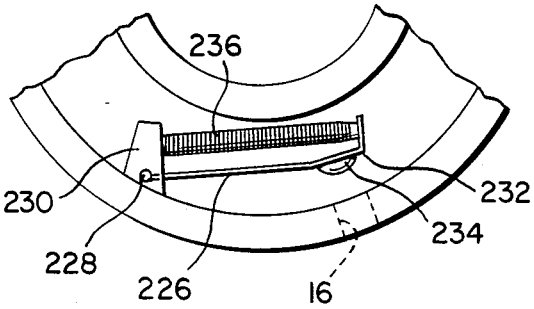

In FIG. 14, a stainless steel plate 226 is shown mounted at one end 228 in projection 230. Opposite end 232 of plate 226 includes a curved closure member 234 and is connected to spring 236 which is also attached to projection 230. Upon rotation of the propeller in a predetermined speed range, the closure member 234 is seated in opening 16 to seal the opening which communicates between the annular passageway formed between the inner and outer hubs and the exterior surface of the outer hub.

Figure 15:
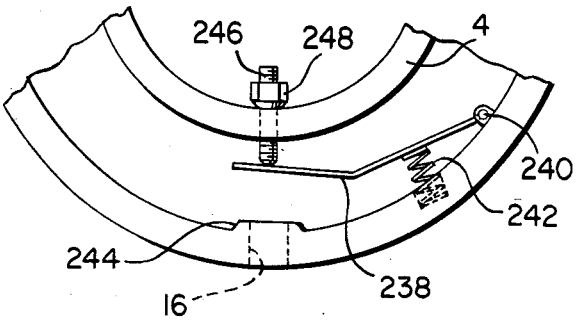

In FIG. 15, a plate 238 is pivotably mounted at end 240 in an inner wall of the outer hub 6. A spring 242 biases the plate 238 away from opening 16. Opening 16 includes a raised shoulder 244 which is cast in the outer hub to provide a flat valve seating against the flat end of plate 238. An adjustable stop includes a shaft 246 threadably mounted in inner hub 4 and is held in place by nut 248.

During rotation of the propeller, plate 238 is forced by centrifugal force towards opening 16 and seats itself on shoulder 244 to seal flow communication through opening 16 from the annular passageway formed between the inner and outer hubs and the exterior surface of the outer hub.

Figure 16:
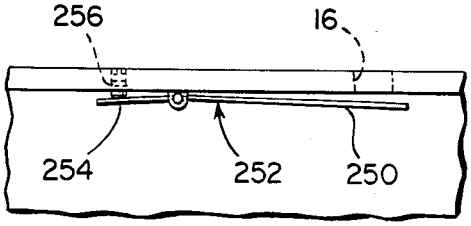
Figure 17:
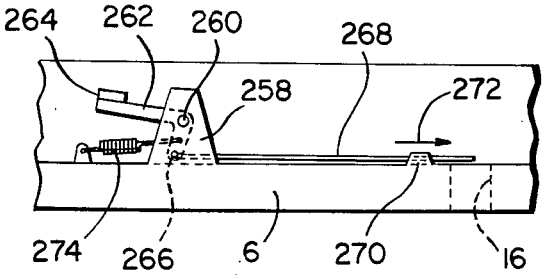

In FIGS. 16 and 17, closure devices are shown which are aligned along the longitudinal axis of the outer hub. In FIG. 16, a stainless steel plate 250 is pivotably mounted on a shaft and spring assembly at 252 and includes one end 254 biased against stop screw 256. Screw 256 is adjusted for changing the speed at which the plate 250 is moved towards opening 16 to seal the opening 16.

In FIG. 17, a projection 258 includes a pivot pin 260 about which L-shaped crank 262 is pivoted. One arm of the crank 262 includes a weight 264. The other end of the other arm of the crank 262 is pivotably connected at 266 to plate 268 which is slideably mounted through guide 270 for moving in the direction of arrow 272 for closing opening 16 upon movement of the weight 264 towards the outer hub 6 due to centrifugal force when the propeller is rotated. A spring 274 biases plate 268 away from opening 16 in a normal at rest position.

In FIG. 18, a plate 280 is pivotably mounted at 282 and is biased by spring 284 away from opening 16 so that application of a centrifugal force during rotation of the propeller causes plate 280 to move toward opening 16 to completely cover and seal opening 16. Anchor 286 mounted on a wall of inner hub 4 includes three different anchoring positions for attaching one end of spring 284 to inner hub 4 and thereby adjusting the speed of rotation at which the plate 280 will cover and seal opening 16.

In FIG. 19, a closure device mounted along the longitudinal axis of the outer hub includes a stainless steel plate 288 which is pivotably mounted at end 290 on outer hub 6. Spring 292 is connected at one end to plate 290 and at the other end is connected to a screw tension adjustment assembly 294 for varying the tension on the plate 290 by movement of an end of spring 292 towards and away from plate 288.

In FIG. 20, stainless steel plate 296 includes sealing member 298 at one end and its opposite end is pivotably mounted at 300 by the force of a spring having one end 302 located at one side of pivot 300 and the other end 304 located on the opposite side of pivot 300 to bias plate 296 away from outer hub 4 and opening 16. Upon rotation of the propeller, the sealing member 298 is moved away from stop 306 and towards outer hub 6 to seal opening 16 due to centrifugal force.

In FIGS. 21 and 22, a closure device is shown mounted along the longitudinal axis of outer hub 6. FIG. 21 illustrates the closure device in an open position and FIG. 22 illustrates the closure device in a closed position.

In FIG. 23, an adjustable stop 306 engages stainless steel plate 308 having sealing member 310 mounted at one end and having its other end pivotably mounted at 312 to the inner wall of outer hub 6. Spring 314 extends between plate 308 and anchor point 316. Spring 314 is also connectable to alternate anchors 318 and 320 for increasing the bias on the plate 308 away from opening 16 as held in fixed position by stop 306. In this embodiment, it is possible to so adjust the bias on the plate 308 so that a relatively precise predetermined speed of rotation range is determined for rapid closure of opening 16 by sealing member 310.

Figure 24:
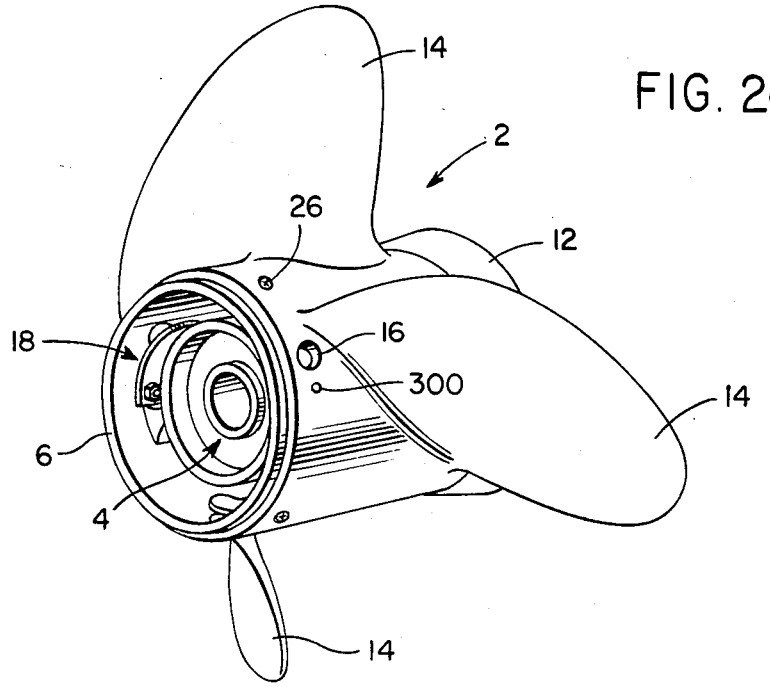
FIGS. 24 and 25 show anti-cavitation devices being used in conjuction with aeration holes and closures.
Figure 25:
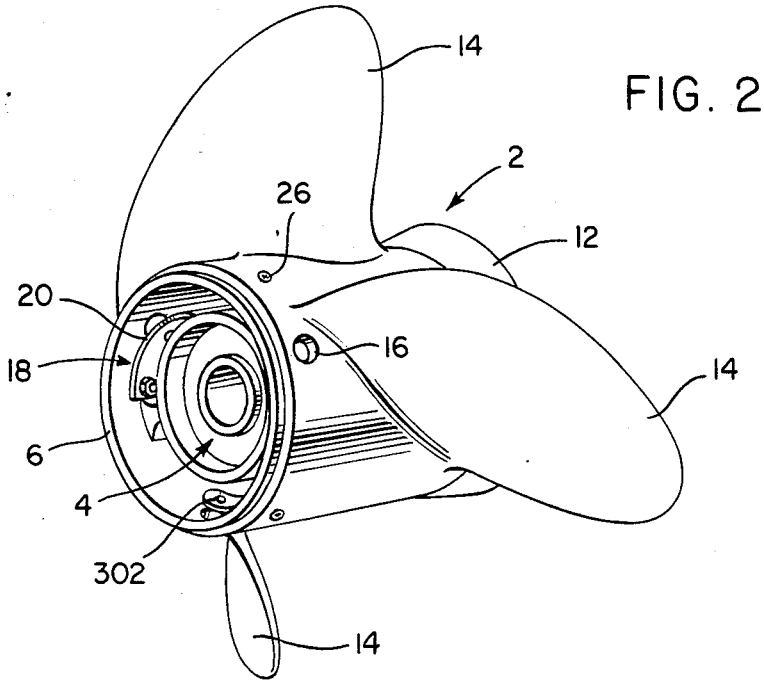

The present invention contemplates the use of anti-cavitation holes in conjunction with aeration holes. In FIG. 24, anti-cavitation hole 300 is located adjacent to aeration opening 16. In FIG. 25, aeration hole 302 is shown defined by reed value 20 so that when reed value 20 is closed a small amount of gas is allowed to escape to an area adjacent to the propeller promoting anti-cavitation.

The present invention has referred to exhaust gases as traveling through the annular passage 10 and then, depending upon whether the opening 16 has been closed by any of the assemblies described for sealing the opening 16, passes through the openings 16 to promote aeration and increase power at low speeds. It should be understood that exhaust gas is not the only source of gas for promoting aeration, but rather, it is only necessary that there be a gas. It is possible to feed atmosphere from the marine propulsion device motor to the annular passageway 10 by the suction created by the propeller during rotation, as is done in stern drive engines.

Once the openings in the outer hub have been completely closed by the closure assemblies, high speed propeller power and boat performance is obtained.

An anti-cavitation device may also be employed with aeration holes. Anti-cavitation holes may be drilled in closure assembies to allow small amounts of gas to escape to an area adjacent to the prop when the closure assembly is in a closed position. Assemblies may also be disigned to remain partially open at peak engine R.P.M.s, to promote anti-cavitation.

Having described the invention, many modifications thereto will become apparent to those skilled in the art to which it pertains without deviation from the spirit of the invention as defined by the scope of the appended claims.

I claim:

1. A propeller comprising:

an inner hub having an outermost wall, an outer hub having an innermost wall, said outer hub being supported in spaced relation to and surrounding said inner hub, an annular passageway defined between said outermost wall of said inner hub and said innermost wall of said outer hub, a plurality of blades mounted on said outer hub, a plurality of openings defined by said outer hub, each of said plurality of openings being located adjacent to a root of a leading edge of one of said plurality of blades, reed valve means mounted in said annular passageway, said reed valve means including an elongated reed having a thickness substantially less than its length and width, said elongated reed being positioned in said annular passageway so that the restriction of gas flow through said annular passageway by the thickness of said elongated reed minimizes the blockages of gas flow through said annular passageway, said reed valve means being located adjacent each of said plurality of openings and biased away from each of said plurality of openings for moving towards each of said plurality of openings and at least partially sealing each of said plurality of openings due to centrifugal force acting against a bias of said reed valve means during rotation of the propeller in a predetermined speed range, said plurality of openings being substantially free of blockage by said reed valve means of gas flow through said openings outside of said predetermined spped range due to the bias of said reed valve means away from said plurality of openings, and anticavitation means for allowing a small amount of gas to escape to an area adjacent to said plurality of blades when said reed valve means covers said plurality of openings.

2. A propeller as claimed in claim 1, wherein said reed valve means is mounted at one end on said inner hub.

3. A propeller as claimed in claim 1, wherein said reed valve means is mounted at one end on said outer hub.

4. A propeller as claimed in claim 1, wherein said reed valve means includes an adjusting means for adjusting the force required to cause said reed valve means to seal each of said plurality of openings.

5. A propeller comprising:

an inner hub, an outer hub supported in spaced relation to and surrounding said inner hub, an annular passageway defined between said inner hub and said outer hub, a plurality of blades mounted on said outer hub, a plurality of openings defined by said outer hub, each of said plurality of openings being located adjacent to a root of a leading edge of one of said plurality of blades, closure means mounted in said annular passageway adjacent each of said plurality of openings and biased away from each of said plurality of openings for movement towards each of said plurality of openings and sealing of each of said plurality of openings due to centrifugal force acting against the bias of said closure means during rotation of the propeller in a predetermined speed range, and anticavitation means for allowing a small amount of gas to escape to an area adjacent to said plurality of blades when said closure means covers said plurality of openings.

6. A propeller comprising:

a propeller hub having an inner hub and an outer hub supported in spaced relation to and surrounding said inner hub, an annular passageway defined between said inner hub and said outer hub, a plurality of blades mounted on said outer hub, a plurality of openings defined by said outer hub, each of said plurality of openings being located adjacent to a root of a leading edge of one of said plurality of blades, plate closure means for each of said plurality of openings, said plate closure means having two ends, one end being pivotably connected to said propeller hub and the other end adapted to seal each of said plurality of openings, bias means for each of said plate closure means, said bias means having two ends, one end connected to said plate closure means and the other end being connected with said propeller hub, said plurality of openings being sealed by said plate closure means upon centrifugal force overcoming the bias of said bias means during rotation of the propeller in a predetermined speed range, and stop means limiting the spacing of said plate closure means from said plurality of openings.

7. A propeller as claimed in claim 6, wherein said stop means project from said inner hub.

8. A propeller comprising:

a propeller hub having an inner hub and an outer hub supported in spaced relation to and surrounding said inner hub, an annular passageway defined between said inner hub and said outer hub, a plurality of blades mounted on said outer hub, a plurality of openings defined by said outer hub, each of said plurality of openings being located adjacent to a root of a leading edge of one of said plurality of blades, plate closure means for each of said plurality of openings, said plate closure means having two ends, one end being pivotable connected to said propeller hub and the other end adapted to seal each of said plurality of openings, bias means for each of said plate closure means, said bias means having two ends, one end connected to said plate closure means and the other end being connected with said propeller hub, said plurality of openings being sealed by said plate closure means upon centrifugal force overcoming the bias of said bias means during rotation of the propeller in a predetermined speed range, and said one end of said bias means being positionable at different points along said outer hub to vary the tension of said bias means.

9. A propeller comprising:

a propeller hub having an inner hub and an outer hub supported in spaced relation to and surrounding said inner hub, an annular passageway defined between said inner hub and said outer hub, a plurality of blades mounted on said outer hub, a plurality of openings defined by said outer hub, each of said plurality of openings being located adjacent to a root of a leading edge of one of said plurality of blades, plate closure means for each of said plurality of openings, said plate closure means having two ends, one end being pivotably connected to said propeller hub and the other end adapted to seal each of said plurality of openings, bias means for each of said plate closure means, said bias means having two ends, one end connected to said plate closure means and the other end being connected with said propeller hub, said plurality of openings being sealed by said plate closure means upon centrifugal force overcoming the bias of said bias means during rotation of the propeller in a predetermined speed range, and said one end of said bias means being positionable at different points along said inner hub to vary the tension of said bias means.

* * * * *